United States Patent [19]

Landis

[11] Patent Number: 4,865,216

[45] Date of Patent: Sep. 12, 1989

[54] TEAR-STRIP CLOSURE AND CONTAINER ASSEMBLY

[75] Inventor: H. Richard Landis, Oak Lawn, Ill.

[73] Assignee: Landis Plastics, Inc., Chicago Ridge, Ill.

[21] Appl. No.: 132,921

[22] Filed: Dec. 15, 1987

[51] Int. Cl.[4] ..... B65D 41/48

[52] U.S. Cl. ..... 220/270

[58] Field of Search ..... 220/270, 276; 215/256

[56] References Cited

U.S. PATENT DOCUMENTS 3,032,226 5/1962 Terwilliger ..... 215/256

4,103,803 8/1978 Irvine ..... 215/256 X

*Primary Examiner*—Donald F. Norton

*Attorney, Agent, or Firm*—Fitch, Even, Tabin & Flannery

[57] ABSTRACT

Disclosed is a closure and container assembly for a large-volume container, having an upper rim portion encircled by upper and lower spaced-apart outwardly-extending flanges. The closure includes a one-piece plastic body having a top panel and an encircling skirt downwardly depending from the top panel and integrally attached thereto. A removable tear strip is formed on the lower portion of the skirt and when the closure is fully installed, has a lower free end adjacent the lower flange of the container. A locking bead extends radially inwardly from the tear strip so as to engage an upper flange of the container, retaining the closure thereto. The tear strip includes a first pull tab and a line of weakness to provide a breakable connection between the lower tear strip and the upper portion of the skirt. A second pull tab is located between the first pull tab and the trailing end of the tear strip and remains attached to the closure after removal of the tear strip.

23 Claims, 1 Drawing Sheet

TEAR-STRIP CLOSURE AND CONTAINER ASSEMBLY

BACKGROUND OF THE INVENTION

1. Field of the Invention

The invention relates to a plastic closure and container assembly which is made inexpensively with injection molding equipment, and more particularly, to a closure and container assembly having a tamper-evident band or tear-off strip which is removed the first time the closure is opened so as to provide a tamper-evident feature for the container and closure.

2. Brief Description of the Prior Art

The present invention is particularly useful with a container having a security or Saturn ring comprising a ledge-like flange outwardly projecting from the container sidewall at a location immediately below the closure skirt so as to limit access to the lower edge of the skirt. Because the container security ring projects radially outwardly from the container wall beneath the closure skirt and has a larger diameter than that of the closure skirt, the closure skirt is effectively shielded from glancing blows during shipping and handling which might tend to dislodge the closure from the container. Further, the security ring makes it relatively difficult to obtain access to the closure skirt for intentional prying of the closure in an attempt to leave the tamper-evident band intact.

Paint containers of the above-described type are currently being provided in relatively large-volume (e.g., 5 gallon) sizes. An important feature of such containers is a ready indication of the container's previous opening, which would thereby expose the contents of the containers to possible contamination and premature drying. However, it will be appreciated that prior to opening, the closure must be securely engaged with the container, not only to provide an air-tight seal necessary to prevent deterioration such as premature hardening of the contents, but also to ensure that the contents remain sealed within the container so as to avoid leakage of the container contents during shipping and handling of the container.

Often the five gallon paint containers are desired to be closed after a part of the paint in the container is used to prevent drying of the paint in the container. Thus, it is desired that the closure be able to grip the container rim after removal of the tear strip so as to hold the closure onto the container.

SUMMARY OF THE INVENTION

Accordingly, it is an object of the present invention to provide a container and closure assembly in which the closure effectively seals the container and maintains sealing engagement therewith despite rough handling of the container, even when charged with voluminous, weighty material.

Yet another object of the present invention is to provide a closure of relatively simple inexpensive construction having a tear strip for tamper indication which is strong enough to maintain sealing engagement between the closure and container during rough handling, yet which is easily separated from the closure to allow access to the container contents and yet which can be reapplied to frictionally grip the container rim.

These and other objects of the present invention are provided in a closure and container assembly in which the container has an upper rim portion encircled by upper and lower spaced-apart, outwardly-extending flanges. The closure is formed of a one-piece plastic body and has a top panel enclosing most of the container opening. An encircling skirt integrally formed with the top panel depends downwardly therefrom. The skirt includes a lower removable tear strip, the lower end of which is disposed adjacent the lower container flange when the container and flange are mated. A locking bead is carried on and extends radially inwardly from the tear strip and engages the upper container flange so as to maintain sealing of the closure and container. The tear strip portion of the encircling skirt has a leading end with an integrally-formed first pull tab which, when grasped, allows the tear strip to be torn from the remaining skirt portion. A second pull tab, formed from a portion of the tear strip, is located between leading and trailing ends of the tear strip. A frangible bridge attaches the leading end of the tear strip and one end of the second pull tab. A transverse line of weakness separates the other end of the second pull tab and the trailing end of the tear strip. A line of weakness is located between the tear strip and the remaining skirt portion. The lower tear strip is radially outwardly offset from the upper skirt portion at the location of the upper container flange. Preferably, the tear strip and the upper skirt portion each have a rectangular cross section, with the upper inside corner of the tear strip joined to the lower outside corner of the upper skirt portion at the frangible line of weakness.

BRIEF DESCRIPTION OF THE DRAWINGS

In the drawings, wherein like elements are referenced alike.

DETAILED DESCRIPTION OF THE PREFERRED EMBODIMENT

Figure 1:
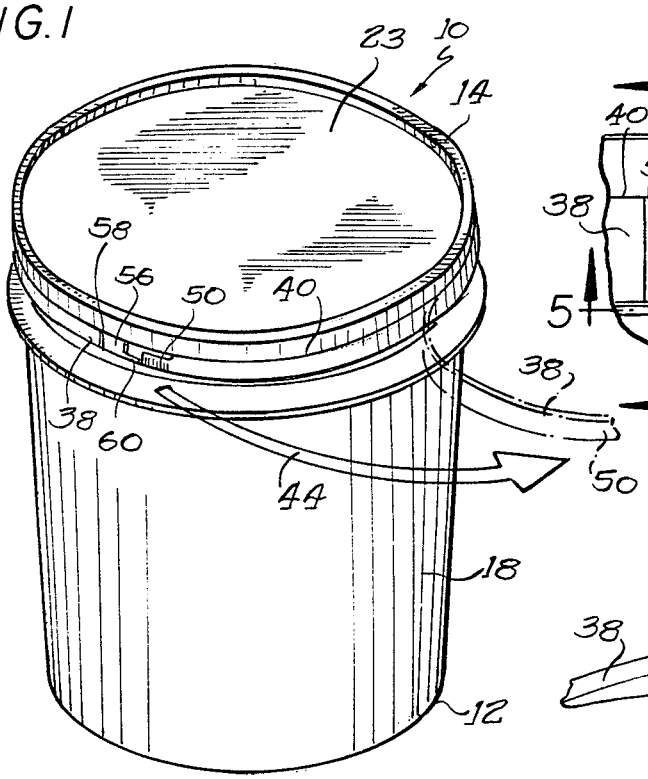
FIG. 1 is a perspective view of a container and closure assembly illustrating principles of the present invention.

Referring now to the drawings, a container and closure assembly 10 for holding a large volume includes a container 12 and a closure 14. The container 12 and closure 14 are each preferably formed of a resiliently flexible polymeric material such as a high density polyethylene. The container has a circular bottom wall (not shown) and a slightly tapered but generally cylindrical sidewall 18 having an upper rim 20 bounding or encircling an open end 22. The closure 14 has a top panel 23 for covering the open end 22 of container 12. The upper, open end of container 12 further includes upper and lower outwardly-extending ledge-like flanges 24, 26. The upper flange 24 includes upper and lower surfaces **24*a*, 24*b*, respectively, and the lower flange 26 includes an upper surface 26*a*. The flanges 24, 26** are particularly useful for relatively large-volume containers and, in addition to other uses as will be discussed herein, the flanges add rigidity and strength to the upper open end of the container.

Figure 3:
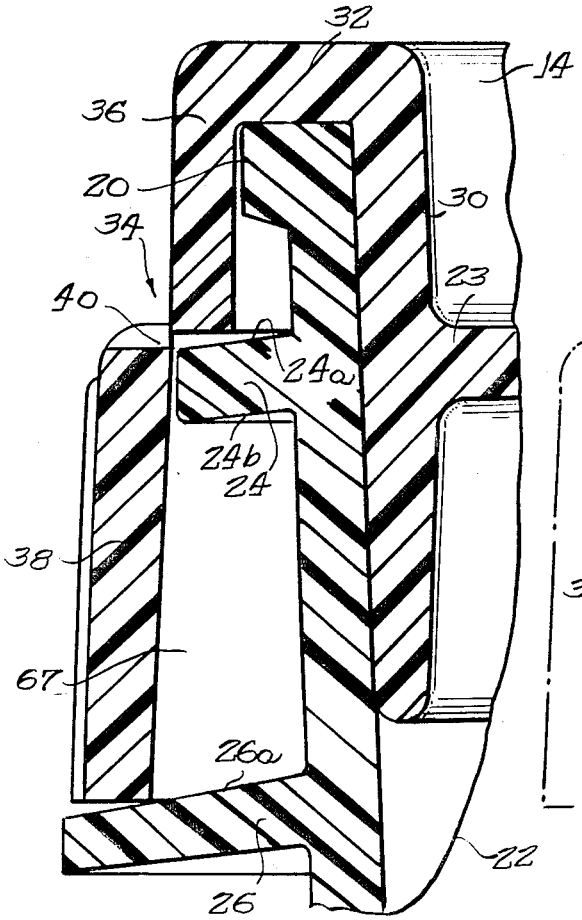
FIG. 3 is a fragmentary cross-sectional view taken substantially along the line 3—3 of FIG. 2 and looking in the direction of the arrows.
Figure 4:
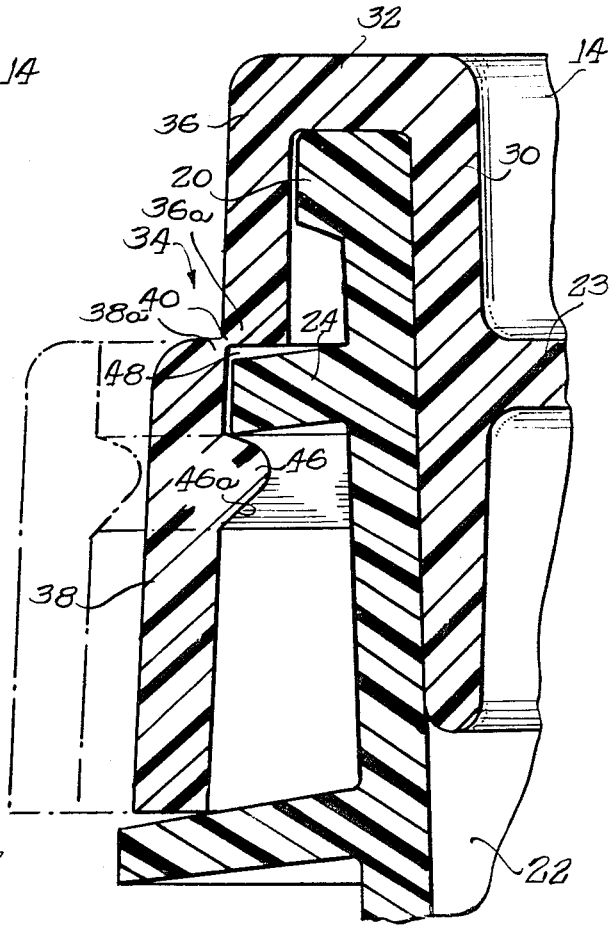
FIG. 4 is a fragmentary cross-sectional view taken substantially along the line 4—4 of FIG. 2 and looking in the direction of the arrows.

Referring especially to FIGS. 3 and 4, closure 14 includes an inner wall 30 generally cylindrical in configuration but somewhat tapered so as to accommodate the slight tapering of the container 12. The interior wall 30 extends below the closure panel 23 and has a significant length to provide enhanced engagement with the interior surface of the container sidewall 18. Outwardly extending from the top of closure wall 30 is an annular top wall 32 which continues the sealing engagement between the container and closure. Downwardly depending from top wall 32 is an annular skirt generally indicated at 34. The skirt 34 is divided into an upper body portion 36 and a lower tear-strip 38 by a line of weakness 40. As will be seen, the tear strip 38, when manually grasped at the leading end thereof, is easily torn from the upper body portion 36, thereby allowing access to the interior of container 12. Tear strip 38 also offers sealing engagement with the upper flange of container 12. As will be seen, the container and closure assembly result in simplified, economical construction and does not provide a sealing bead at the upper portion of skirt 34 which would remain after the tear strip 38 is removed.

Referring now to FIGS. 3 and 4, it is seen that the preferred upper body portion 36 of skirt 34 and the tear strip 38 both have generally rectangular cross-sectional configurations. According to an important aspect of the present invention, the tear strip 38 is laterally or radially outwardly offset from the upper body portion 36. Referring especially to FIG. 4, it can be seen that a slight overlap is provided between adjacent corners of upper body portion 36 and tear strip 38. More particularly, the lower outside corner 36*a* of upper body portion 36 and the upper inside corner 38*a* of tear strip 38 are disposed immediately adjacent each other, with the corner portion 38*a* below and radially outside of the corner portion 36*a*. The slight overlap between the tear strip and upper skirt portion forms a weakened line 40 which is readily torn upon grasping and pulling the tear strip 38, so as to separate the tear strip from the upper body portion 36, as indicated by the arrow 44 of FIG. 1.

Integrally molded with the tear strip portion of closure 14 is a radially inwardly-directed locking bead 46. As indicated in FIG. 4, the closure skirt defines a recess 48 between the lower end of body portion 36 and the upper end of bead 46. When flange 24 is fully received in recess 48, the lower outside corner of flange 24 and preferably the lower surface 24*b* thereof is maintained in contact with the upper edge of bead 46 so as to provide the sealing force necessary to maintain the upper surface of rim 20 in intimate sealing engagement with the lower surface of top wall 32. As shown in FIG. 4, the lower end of locking bead 46 is upwardly inclined so as to form a camming surface 46*a*, for sliding contact with the upper outside corner of flange 24 as the closure is installed about the upper end of container 12. As closure 14 is pressed into downward engagement with container 12, a compressive loading across the line of weakness 40 is developed, particularly as locking bead 46 engages and is cammed over upper flange 24. Accordingly, it is important that the line of weakness 40 be able to withstand such compressive loading during mating of the closure to the container. The weak portion 40 formed by the slightly overlapping corners of a tear strip and upper skirt portion exhibits the necessary strength while providing a one-piece closure of simplified economical design.

It is generally preferred that the inner closure wall 30 extend below the line of weakness to give close control of the movement of the closure skirt as the upper flange 24 is deflected past bead 46, and snaps into recess 48. It is further desirable to locate closure panel 23 so that the outer periphery thereof generally opposes the line of weakness 40 and recess 48. This maximizes the stiffness of the inner closure wall 30 at the point where the lateral (i.e., radial) loading on skirt 34 is the greatest. Such stiffness aids in controlling the deflection of skirt 34 and in distributing the local stresses on skirt 34 (i.e., stresses localized at a particular radial location about cylindrical container 12, during mating of the closure and container, particularly when the closure is unevenly applied to the container open end. The slightly tapered, generally funnel-shaped inner wall aids in aligning the closure and container free end, before the closure is seated on the container. Further, the lower portion of inner wall 30 extending below panel 23 provides a resilient cantilever member outwardly biasing and reinforcing container wall 18 against inward deflection as upper flange 24 is stressed by closure bead 46. The relatively long moment arm of skirt 34, as taken from its recess 48 to an upper end where it is resiliently hinged to top wall 32, maintains inner wall 30 in sealing engagement with the inner surface of container wall 18. These several intercooperating features are provided in a simple and economically formed closure.

Figure 2:
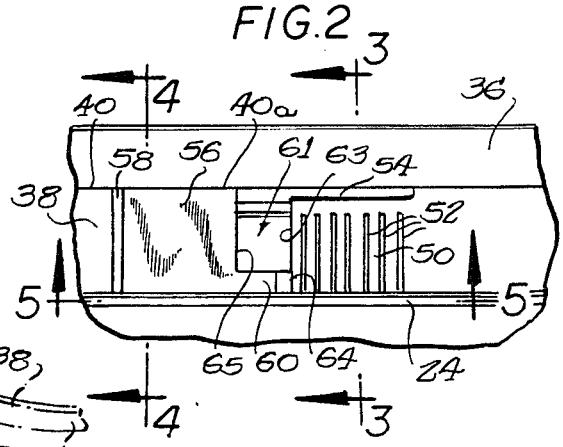
FIG. 2 is a fragmentary view of the pull tab and tear strip portion of the closure of FIG. 1.
Figure 5:
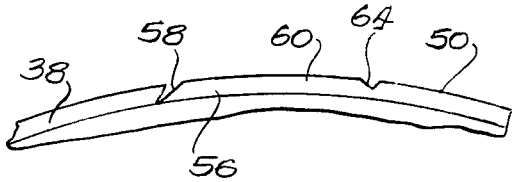
FIG. 5. is a fragmentary cross-sectional view showing the lower edge of the closure of FIG. 2, taken along lines 5—5 thereof and looking in the direction of the arrows.

Those skilled in the plastic molding art will readily appreciate that the line of weakness 40 offers advantages in ensuring a flow of plastic mold material into the relatively small area formed between adjacent corners 38*a*, 36*a* of the tear strip and upper skirt portion. One additional advantage of the line of weakness of the preferred embodiment is its ease of tearing, and in particular, its ease of initial tearing at the leading end of the tear strip where separation of the tear strip and upper skirt portion is begun. Another additional advantage of the line of weakness of the preferred embody is its function as a fold line for a second pull tab which remains attached to the closure after removal of the tear strip therefrom. The second pull tab, as will be seen is outwardly folded away from the closure to allow the user to readily grasp the closure, facilitating the opening of the container by lifting the closure away therefrom. Referring especially to FIGS. 2 and 3, a first manually graspable pull tab 50 is formed at the leading end of tear strip 38. Pull tab 50 preferably includes a number of transverse ribs 52 to aid a user in maintaining a grip on the pull tab, especially during application of tensile forces to the tear strip. As indicated in FIG. 2, the upper portion of pull tab 50 includes a recess 54 spaced from the line of weakness 40, thereby allowing the pull tab to be readily pulled away from the closure to facilitate subsequent tearing and to provide a user with the leverage necessary to initiate cicumferentially-directed tearing at the line of weakness without requiring tools or other equipment. A second pull tab 56 is formed from a portion of tear strip 38 and remains attached to the closure after the tear strip 38 is separated therefrom. A line of weakness 40 preferably extends through the second pull tab 56 and is designated thereat by the numeral 40*a*. As will be seen, the portion 40*a* of the line of weakness serves as a fold line, allowing the upward folding of the pull tab 56 away from the container 12. Pull tab 50, formed at the leading end of tear strip 38, is joined to one end of the second pull tab 56 by a frangible bridge 60. A transverse line of weakness 58 separates the other end of the second pull tab 56 from the trailing end of tear strip 38. In operation, a user grasps the upper corner of the pull tab 50, thereby deflecting the upper corner of the pull tab away from closure 14. This minimal amount of stress is sufficient to break a frangible connection along line 64 (see FIG. 2) joining the pull tab 60 to the free end of pull tab 50. As best seen in FIGS. 1 and 2, an open space 61 is provided above the bridge 60 between leading edge 63 of the pull tab 50 and trailing end 65 of the tear strip 38. A screwdriver or other tool may be inserted into the open space 61 and positioned in the groove 67 radially inward of the tear tab and between the flanges 24 and 26 and may be used to pry the tab outwardly for better grasping. The transverse line of weakness 58 causes the tearing along the circumferential line of weakness 40 to terminate before reaching the second pull tab 56, which accordingly remains attached to the closure 14. That portion 40*a* of the line of weakness 40 which joins the second pull tab 56 to closure 14 functions as a fold line, allowing the second pull tab 56 to be outwardly folded to form an ear-like attachment to closure 14, providing a user with the leverage needed to easily separate closure 14 from container 12 to complete the opening operation. Further, the second pull tab 56 remains attached for subsequent opening operations. Thus, whereas the first pull tab 50 allows a user to grasp the leading end of tear strip 38 for pulling in a circumferential direction, the second pull tab 56 allows the user to pull closure 12 in a generally transverse direction parallel to the axis of container 12. The second pull tab 56 is economically formed from a trailing portion of tear strip 38 and requires only the formation of the transverse line of weakness 58 to complete its formation. The transverse line of weakness 58 preferably has a wedge-shaped cross section and undercuts the trailing end of tear strip 38, as illustrated in FIG. 5.

In order to prevent the unintentional dislocation of closure 14 from container 12, as during shipping and handling of the closure and container assemblies, flange 26 is preferably dimensioned to underlie the entire bottom edge of tear strip 38, as illustrated in FIGS. 3 and 4. Thus, if another container should strike a glancing blow upwardly directed at closure 20, the blow will be deflected away from the closure (i.e., tear strip) by the lower flange 26. It is preferred that the lower free end of tear strip 38 be closely spaced to the upper surface 26*a* of flange 26 so as to prevent the prying of closure 14 away from container 12, thereby circumventing a rupture of the tear strip at its line of weakness. Thus, the close spacing between the bottom free end of tear strip 38 ( i.e., of skirt 34) and the upper surface of flange 26 prevent implements (such as screwdrivers, pry bars or the like) from passing inwardly beneath the tear strip, so as to gain the leverage needed to pry the tear strip away from the container. As a further precaution, the lower flange 26 can be made flexible so as to deflect any leverage force applied thereagainst which would pry the closure free of the container.

The close spacing of the bottom end of the tear strip 38 with the lower flange 26 can also assist in guiding the closure to a fully seated condition with respect to container 12. That is, when the closure is fully seated about the container, the bottom free end of the tear strip is brought into engagement with the lower flange 26. However, as described above, it is preferred that lower flange 26 be made relatively resilient, and accordingly it would not be available to restrain downwardly-directed overtravel of the closure during mating with the container, it being generally preferred that such overtravel is prevented by engagement between rim 20 and top wall 32, and to a lesser extent, the engagement between the bottom end of skirt portion 36 and the upper flange 24. Preferably, stress on the line of weakness transmitted through the relatively long moment arm of tear strip 38 should be avoided, particularly since such stress would likely be accompanied by an outward bowing of the tear strip 38, owing to its outwardly-directed flare, as well as the downwardly-directed inclination of lower flange 26.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A closure for a container having a locking flange thereon adjacent a rim on the container, said closure comprising:

a one-piece plastic body having a top circular panel;

an interior wall depending from the top circular panel to abut an inner surface of the container rim;

an encircling skirt having upper and lower portions and connected to the top panel and spaced from the interior depending wall to define an inverted U-shaped channel for receiving the rim of the container;

a removable tear strip on the lower portion of the skirt for removal to indicate that the closure has been opened, the tear strip including an inner wall having an upper corner;

a pull tab integral with the tear strip for grasping to tear the tear strip from the upper portion of the skirt;

a locking means on the tear strip for engaging the locking flange on the container to lock the closure on the container;

an outer wall on the upper portion of the skirt having a lower corner;

frangible means joining the upper inner wall of the tear strip to the lower corner of the skirt upper portion for breaking with removal of the tear strip; and a second pull tab formed as a first portion of said tear strip separated from the remaining portion of tear strip by a line of weakness which prevents breaking of that portion of said frangible means joining said second pull tab to the lower corner of the skirt, so that said second pull tab remains joined to the skirt after removal of the remaining portion of the tear strip therefrom.

2. The closure of claim 1 wherein the upper skirt portion and lower tear strip have generally rectangular cross sections with the tear strip located below and to the outside of the upper skirt portion so that adjacent corners of said upper skirt portion and said lower tear strip partially overlap each other to form said line of weakness.

3. The closure in accordance with claim 1 wherein the pull tab integral with the tear strip is located at a leading portion thereof, said line of weakness separating said second pull tab from a trailing end of the tear strip, and said line of weakness undercuts the trailing edge of the tear strip.

4. A closure in accordance with claim 1 in which a lower outer corner of said upper skirt portion and a radially inner corner of the tear strip are closely adjacent and offset from one another, said frangible means joining said corners.

5. The closure of claim 1 wherein said locking means comprises a locking beam radially inwardly extending from said tear strip.

6. The closure of claim 1 further comprising a frangible bridge interconnecting said one pull tab and said second pull tab.

7. The closure of claim 1 further comprising an inner wall interior of said skirt and generally parallel thereto, extending above and below said top panel so as to engage an interior surface of a container mated to said enclosure.

8. The closure of claim 7 wherein said top panel is arranged generally opposite said line of weakness.

9. The closure of claim 8 wherein said locking means comprises a locking bead radially inwardly extending from said tear strip at a point below said line of weakness and said upper skirt portion, said tear strip and said locking bead cooperating to define a flange-receiving recess generally opposite said top panel for receiving a ring-like flange outwardly extending from a container mated with said closure, said skirt resiliently joined to said inner wall so as to apply a compressive force to the container when mated therewith.

10. A closure and container assembly comprising:

(a) a container having an upper rim portion encircled by upper and lower spaced apart outwardly extending flanges; and (b) a closure comprising:

(i) a one-piece plastic body having a top panel;

(ii) an encircling skirt integrally attached to the top panel and having a lower, downwardly extending portion;

(iii) a double-ended removable tear strip on the lower portion of the skirt for removal to indicate that the closure has been opened, said tear strip having a lower free end adjacent said lower flange;

(iv) a locking bead radially inwardly extending from said tear strip for engaging said upper flange so as to retain the closure on the container;

(v) a pull tab integral with the tear strip and located at a leading end thereof for grasping to tear the tear strip from the skirt; and (vi) means for providing a line of weakness in the skirt so as to define a breakable connection between the lower tear strip and the upper portion of the skirt, said means including a radial offset of the lower tear strip relative to the upper portion of the skirt.

11. The closure of claim 10 further comprising a second pull tab located between said one pull tab and a trailing end of said tear strip, said second pull tab separated from a trailing end of said tear strip by a generally transverse line of weakness, and said second pull tab joined to an upper portion of the skirt by a line of weakness defining a fold line allowing outward displacement of said second pull tab so as to project outwardly beyond the upper portion of the skirt, providing grasping of the closure to facilitate removal thereof from the container.

12. The assembly of claim 11 wherein said generally transverse line of weakness undercuts the trailing end of the tear strip.

13. The assembly of claim 10 wherein said tear strip is laterally outwardly offset relative to the upper portion of said skirt.

14. The assembly of claim 13 wherein the upper skirt portion has a lower outside corner and said tear strip has an upper inside corner joined to said skirt corner through said line of weakness.

15. The assembly of claim 13 wherein the upper skirt portion and lower tear strip have generally rectangular cross sections with the tear strip located below and to the outside of the upper skirt portion so that adjacent corners of said upper skirt portion and said lower tear strip partially overlap each other to form said line of weakness.

16. The assembly of claim 10 wherein said locking means comprises a locking bead radially inwardly extending from said tear strip such that the upper portion of said locking bead engages the upper container flange when said closure is mated to said container.

17. The assembly of claim 10 further comprising a second pull tab adjacent a trailing end of said tear strip and joined to said closure to assist in lifting said closure after said tear strip has been removed therefrom.

18. The assembly of claim 10 wherein said container includes a sidewall having inner and outer surfaces and said closure further comprises an inner wall interior of said skirt extending above and below said top panel so as to engage said container inner surface when said closure is mated to said container.

19. The assembly of claim 18 wherein said top panel generally opposes said line of weakness.

20. The assembly of claim 19 wherein said locking means comprises a locking bead radially inwardly extending from said tear strip so that the upper surface thereof engages the container upper flange, said tear strip and said locking bead cooperating to define a recess for receiving the upper flange at a point generally opposite said panel.

21. The assembly of claim 20 wherein said tear strip is laterally outwardly offset relative to the upper portion of said skirt so as to expose a lower edge of said upper skirt portion, said lower edge cooperating with said tear strip and said locking bead to define said recess.

22. The assembly of claim 21 wherein said tear strip includes a lower edge immediately adjacent said lower container flange when said upper container flange is received in said recess.

23. The assembly of claim 22 wherein said lower container flange substantially completely under lies the lower edge of said tear strip.

* * * * *